United States Patent [19]

Taylor

[11] Patent Number: 4,905,386

[45] Date of Patent: Mar. 6, 1990

[54] PROCESS FOR UNEARTHING HAZARDOUS PIPELINE

[75] Inventor: Otis C. Taylor, Lake Jackson, Tex.

[73] Assignee: The Dow Chemical Company, Midland, Mich.

[21] Appl. No.: 240,162

[22] Filed: Sep. 2, 1988

[51] Int. Cl.[4] ..... E02F 1/00

[52] U.S. Cl. ..... 37/195; 37/141 R

[58] Field of Search ..... 37/117.5, 141 R, 195; 172/701.1, 701.3, 747

[56] References Cited

U.S. PATENT DOCUMENTS

| | | | |
|---|---|---|---|
| 3,082,692 | 4/1962 | Brock | 172/701.1 X |
| 4,360,980 | 11/1982 | Jarvis | 37/117.5 |
| 4,550,512 | 11/1985 | Felstet | 37/117.5 |
| 4,571,861 | 2/1986 | Klever et al. | 172/701.1 X |

FOREIGN PATENT DOCUMENTS

| | | | |
|---|---|---|---|
| 2655792 | 6/1978 | Fed. Rep. of Germany | 172/747 |

*Primary Examiner*—Edgar S. Burr
*Assistant Examiner*—Moshe I. Cohen

[57] ABSTRACT

A cutting edge member for fitting onto an excavation apparatus wherein the cutting edge member is of softer material than iron for digging around pipelines.

6 Claims, 2 Drawing Sheets

PROCESS FOR UNEARTHING HAZARDOUS PIPELINE

BACKGROUND OF THE INVENTION

This invention relates to a ground excavation apparatus and more particularly to a cutting edge member for fitting on an excavation apparatus.

Excavation machinery such as "backhoes" and "ditch-diggers" are well known in the art for digging up ground to carry out various jobs, for example, forming a cavity for laying pipeline or uncovering existing buried pipeline. Such machinery is also used for digging around pipelines for maintenance on other nearby equipment.

Typically, excavation machinery such as a backhoe have an "arm" with a "bucket" attached to the end of such arm for cutting, digging or scooping away ground covering to form a cavity in the ground. The cutting edge of the bucket used for cutting the ground, may have a plurality of sharp projecting parts or "teeth" for aiding in digging up the ground or the bucket may have a straight edge (without teeth) for cutting the ground.

The teeth or straight edge making up the cutting edge of the bucket of backhoes and ditch-diggers are, typically, made from hard steel. The cutting edge can easily rupture most pipelines. Excavation near underground pipelines containing flammable fluids such as high vapor pressure hydrocarbons, e.g., liquid propane gas (LPG), is very hazardous when performed with a machine such as a backhoe because the bucket cutting edge can rupture such pipeline and a subsequent explosion of the flammable gas can occur caused by an ignition source such as a spark from friction of the cutting edge contacting the pipeline or by the engine of the backhoe. Moreover, when the precise location of the pipeline carrying flammable fluids is not known, the cutting edge of the excavating machine is apt to strike the pipeline. If the pipeline is ruptured, an uncontrolled release of flammable hydrocarbon vapor into the surrounding atmosphere may occur. This type of accident usually results in loss of life and extensive property loss.

It is desired, therefore, to provide a tool useful as a cutting edge member for fitting onto an existing cutting edge of excavation machinery which will be of sufficient hardness to dig through ground covering but will not damage steel pipelines when the pipeline is struck with such cutting edge during excavation.

SUMMARY OF THE INVENTION

The present invention is directed to a cutting edge for ground excavation machinery including a flat plate with attachment means for attaching to an excavation apparatus: said plate made of softer than iron material such that when the plate is in contact with iron material the plate will deform to avoid damaging the iron material.

Another aspect of the present invention is a process for excavating pipelines using the above cutting edge.

DETAILED DESCRIPTION OF THE PREFERRED EMBODIMENT(S)

Figure 1:
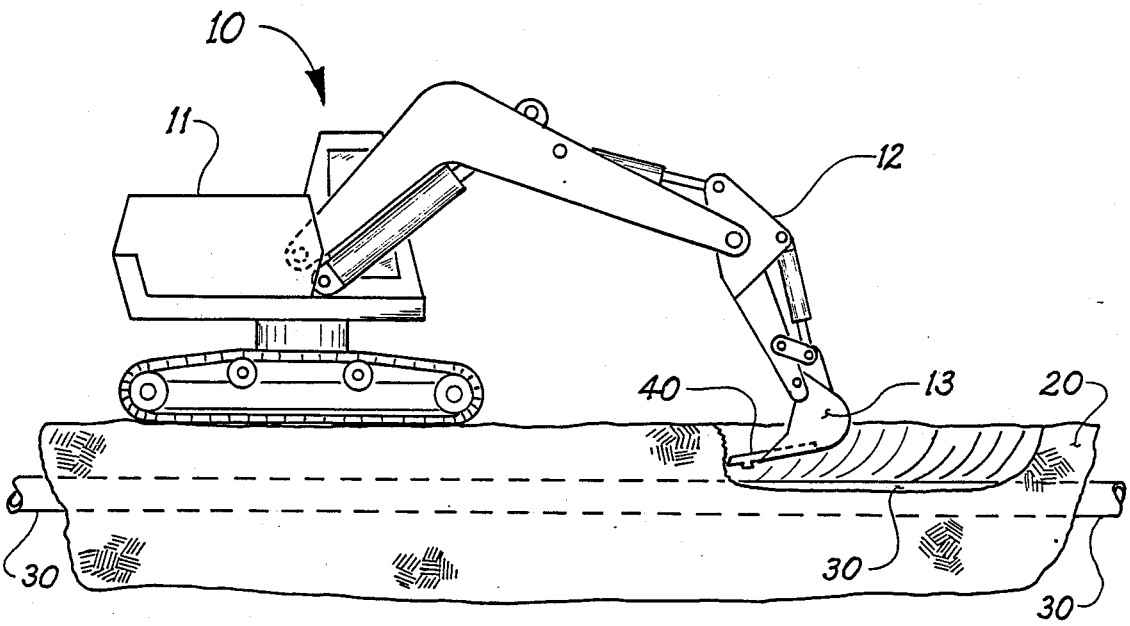
FIG. 1 is a diagrammatic view showing a backhoe with the cutting edge of the present invention.

With reference to FIG. 1, there is shown a backhoe, generally indioated by reference numeral 10, with a body 11, digging arm 12 and a bucket 13 attached to the digging arm 12. The backhoe 10 is used, for example, to excavate the covering of the ground 20 to uncover a buried pipeline 30.

Figure 2:
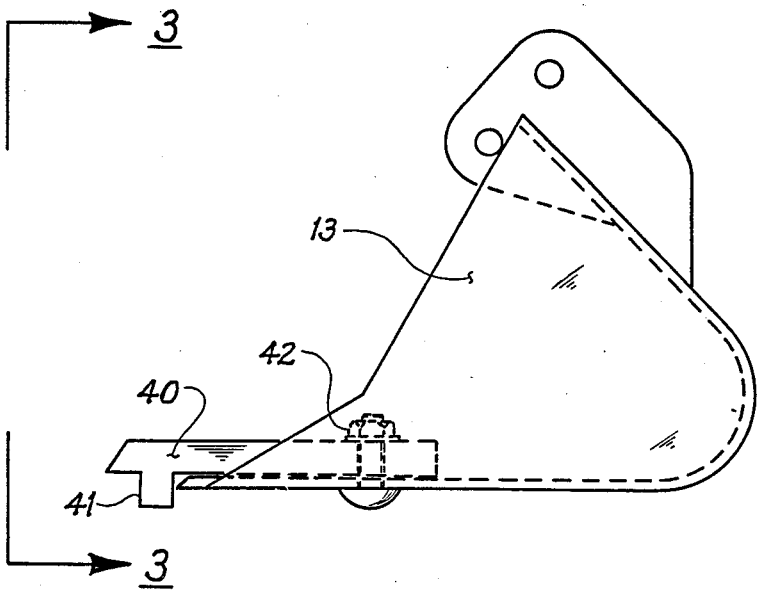
FIG. 2 is a side view showing a bucket with the cutting edge of the present invention.
Figure 3:
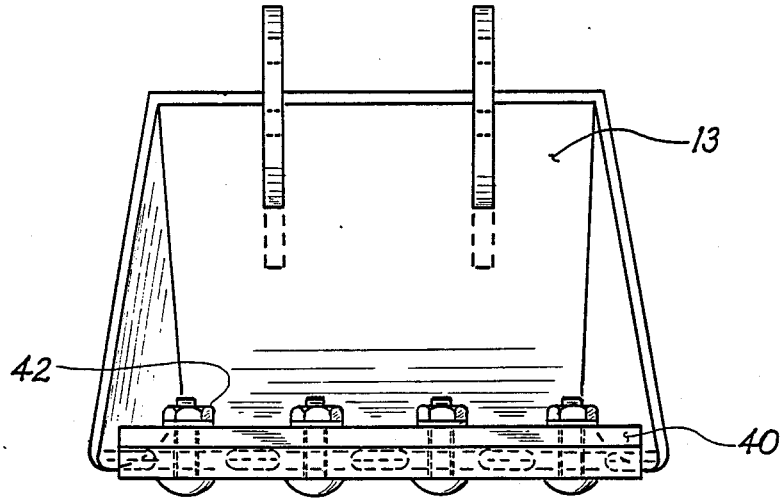
FIG. 3 is a view taken along line 3—3 of FIG. 2.

The bucket 13, illustrated in more detail in FIGS. 2 and 3, contains a cutting edge member 40 attached thereto. The bucket 13 is of a conventional design used on backhoes and made of a conventional metal material such as steel. Optionally, the bucket 13 can be made of the same material as the cutting edge 40.

Figure 4:
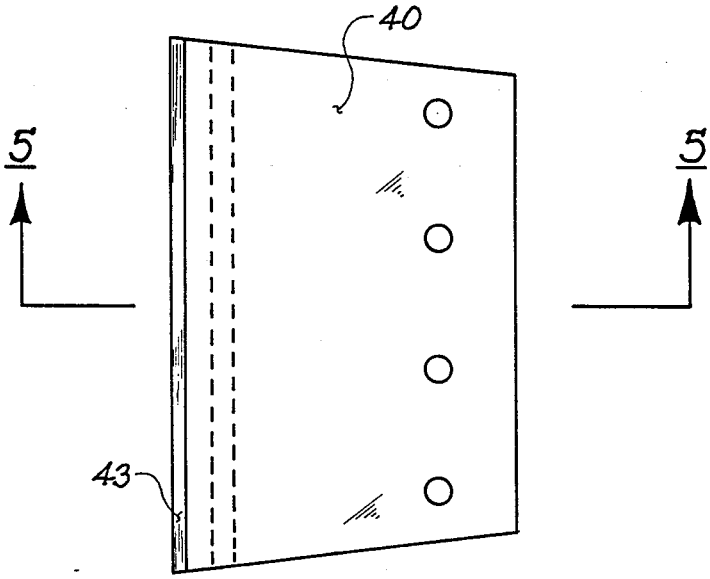
FIG. 4 is a top view of the cutting edge of the present invention.
Figure 5:
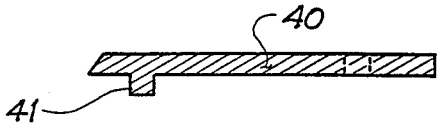
FIG. 5 is a cross-section view taken along line 5—5 of FIG. 4.

The cutting edge 40, shown in FIGS. 4 and 5, comprises a flat plate structure with tapered sides to form a trapezoidal shape when viewed from the top. The shape of the cutting edge is useful for fitting into the inside of the bucket 13. The cutting edge 40 may be flat without serrations or may contain sharp projecting parts similar to the teeth of the bucket. The cutting edge 40 is preferably beveled on one side 43. The cutting edge 40 contains a flat plate portion or rib 41 removably attached to the bottom of the flat plate to butt against the cutting edge or teeth of the bucket and to provide support to the flat plate member. Bolts 42 are used to removably hold and fasten the cutting edge to the bucket.

The cutting edge 40 of the present invention for use with a backhoe is made from soft metals which are softer than steel and which will not rupture or puncture a steel pipeline if the steel pipeline is struck with the cutting edge during normal digging operations. For example, the cutting edge may be made of aluminum, brass, copper, and Monel ® and alloys of these metals. The Rockwell hardness of the cutting edge 40 should be from about B20 to about B50.

The cutting edge should be of sufficient size and dimensions to be removably mounted to conventional digging buckets. In another embodiment, the entire digging bucket can be made of the same material as the cutting edge. While the entire digging bucket can be made, for example, from soft metal such as aluminum, in still another embodiment, it is preferred to make only the leading edge of the bucket lining, for example about 2 to about 4 inches, from the alloy of a soft metal.

The cutting edge may be attached to the bucket by any conventional attaching means such as by welding, clamping or bolting. It is preferred to removably attach the cutting edge to the bucket, for example, by bolting the cutting edge to the bucket with bolts 42 as shown in FIGS. 2 and 3. The cutting edge can then be readily replaced when it is worn or deformed during its use.

In operation, the backhoe bucket scraps the top covering of the ground as the cutting edge cuts through the ground. When the cutting edge contacts a steel pipeline, the cutting edge will deform, e.g., bend, but will not damage the pipeline. Upon deformation of the cutting edge, the cutting edge acts as an indicating means for alerting operating personnel that a pipeline has been struck and manually inspecting the cutting edge. Excavation can then be discontinued or redirected to another location on the ground covering.

EXAMPLE

An aluminum cutting edge, substantially described in FIG. 4, was tested as follows:

The aluminum cutting edge was attached, with bolts, to the bucket portion of a backhoe. A twenty foot section of steel pipeline was placed on top of the ground. The steel pipeline was struck and scraped several times with the "backhoe" having the aluminum cutting edge attachment.

After the test, it was visually observed that the aluminum cutting edge was badly bent and deformed; however, there was no damage to the steel pipe. It was visually observed that rust was not even scraped from the pipe.

After the above test, another aluminum cutting edge, substantially described in FIG. 4, was used to replace the bent cutting edge on a backhoe. The new cutting edge was used for several days to excavate around the process area of Stratton Ridge in Clute, Tex. The soil in this area is a heavy clay or "gumbo" type. It was visually observed that the aluminum cutting edge was somewhat worn after its use, but still did a good job of digging in that type of soil.

What is claimed is:

1. A process for unearthing buried hazardous pipeline without damaging the pipeline comprising:

(a) providing a backhoe bucket with a replaceable cutting edge comprising a flat plate with attachment means for attachment to said backhoe bucket;

(b) selecting the material for said cutting edge such that said cutting edge is softer than the material of said pipeline so that when said plate contacts said pipeline, said plate will deform to avoid damaging the pipeline; of said (c) digging the ground in the vicinity pipeline with said backhoe bucket; and (d) deforming the cutting edge of the backhoe bucket when said bucket contacts the pipeline.

2. The process of claim 1 wherein the cutting edge is provided with a rib member attached to the flat plate member to add support to the flat plate member.

3. The process of claim 1 wherein the flat plate of the cutting edge is provided which contains at least one bore for attaching to the excavation apparatus with at least one nut and at least one bolt.

4. The process of claim 1 wherein the cutting edge is made of aluminum.

5. The process of claim 1 wherein the cutting edge is provided with a beveled edge.

6. The process of claim 1 wherein the cutting edge has a Rockwell hardness of from about B20 to about B50.

* * * * *

UNITED STATES PATENT AND TRADEMARK OFFICE

CERTIFICATE OF CORRECTION

PATENT NO. : 4,905,386

DATED : March 6, 1990

INVENTOR(S) : Otis C. Taylor

It is certified that error appears in the above-identified patent and that said Letters Patent is hereby corrected as shown below:

Column 1, Line 55; correct "ratus: said" to read as -- ratus; said --.

Column 2, Line 8; correct "indioated" to read as -- indicated --.

Column 4, Claim 1(b), Line 8; delete "of said".

Column 4, Claim 1(c), Line 9; after "vicinity" insert -- of said --.

Column 4, Claim 3, Line 17; delete "which contains" and insert thereat -- with --.

Signed and Sealed this

Twenty-fifth Day of June, 1991

*Attest:*

*Attesting Officer*

HARRY F. MANBECK, JR.

*Commissioner of Patents and Trademarks*